US005574330A

United States Patent [19]

Matsuda et al.

[11] Patent Number: 5,574,330

[45] Date of Patent: Nov. 12, 1996

[54] ELECTRON GUN AND METHOD OF ASSEMBLING IT

[75] Inventors: Kenichi Matsuda; Takeshi Mera; Satoru Endo, all of Mobara, Japan

[73] Assignee: Hitachi, Ltd., Tokyo, Japan

[21] Appl. No.: 398,807

[22] Filed: Mar. 6, 1995

[30] Foreign Application Priority Data

Mar. 8, 1994 [JP] Japan ..... 6-037237

[51] Int. Cl.[6] ..... H01J 29/70; H01J 29/46

[52] U.S. Cl. ..... 313/412; 313/428; 313/460

[58] Field of Search ..... 313/412, 414, 313/425, 427, 428, 460

[56] References Cited

U.S. PATENT DOCUMENTS 5,235,241 8/1993 Van Eck et al. ..... 313/414

5,382,872 1/1995 Kim et al. ..... 313/414

*Primary Examiner*—Sandra L. O'Shea

*Assistant Examiner*—Mack Haynes

*Attorney, Agent, or Firm*—Antonelli, Terry, Stout & Kraus

[57] ABSTRACT

There is provided an electron gun which has an assembly precision improved by the reduction of deformation of an electrode during assembly as well as good focusing performance due to the elimination of positional deviation of electron beams. There is also provided a method of assembling such an electron gun. The electron gun comprises a composite electrode including at least two electrode elements united together and a plurality of electrodes sequentially arrayed along a single axis at predetermined intervals. In the electron gun, opposed faces of the electrode elements of the composite electrode are perpendicular to the axis and the opposed faces are provided with projections 1*a* and 1*b* which serve to constitute the composite electrode when the projections are united together in opposed relationship to each other.

5 Claims, 6 Drawing Sheets

FIG. 8a
FIG. 8b
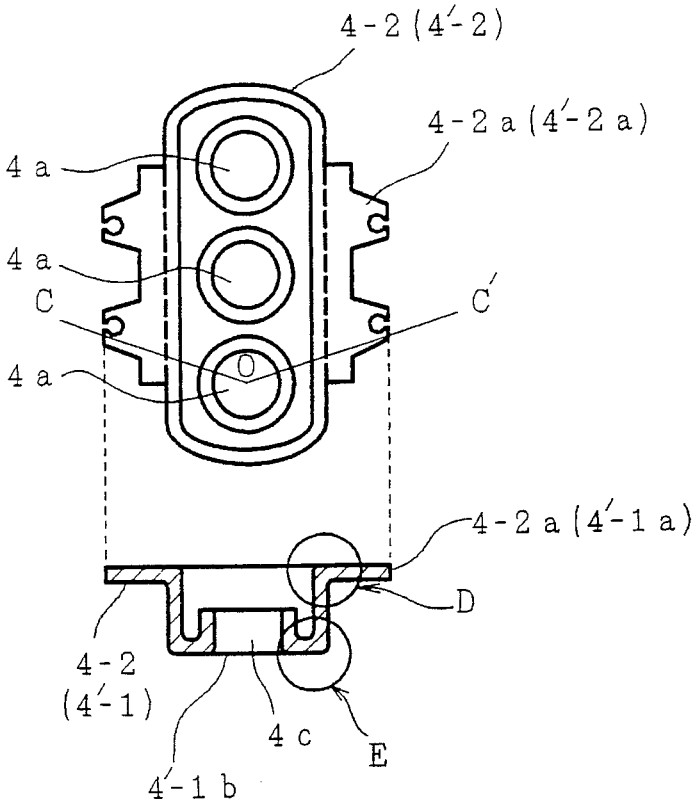
FIG. 8c
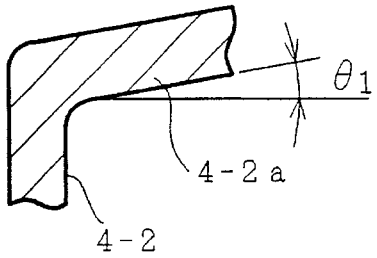
FIG. 8e
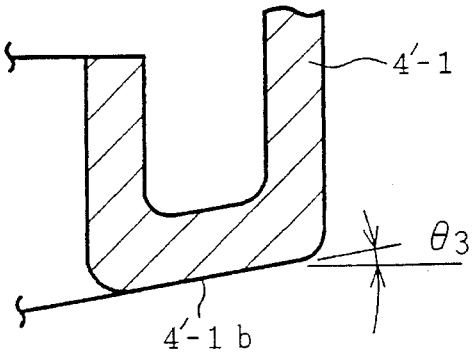
FIG. 8d
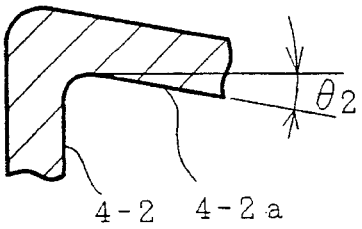
FIG. 8f
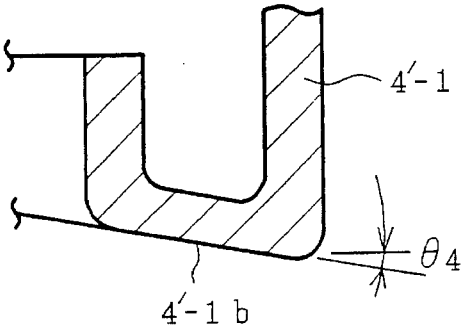

ELECTRON GUN AND METHOD OF ASSEMBLING IT

BACKGROUND OF THE INVENTION

1. Field of the Invention

The present invention relates to an electron gun for a cathode-ray tube and, more particularly, to a precision electron gun improved by the reduction of deformation of an electrode during assembly as well as to a method of assembling such an electrode gun.

2. Description of the Prior Art

Cathode-ray tubes, such as color picture tubes or monitor tubes, are composed to cause electron beams emitted from an electron gun accommodated at one end of a vacuum envelope to strike and excite a phosphor screen formed at the other end thereof, thereby reproducing an image according to the intensity of the electron beams modulated with an image signal.

FIG. 6 is an explanatory cross-sectional view of the structure of this kind of cathode-ray tube. The cathode-ray tube shown in FIG. 6 includes a faceplate 21, a funnel 22, a neck 23 contiguous to the funnel 22, an electron gun 24, a shadow mask 25 having a multiplicity of electron-beam passage holes (apertures), a magnetic shield 26, a phosphor screen 27, a deflection yoke 28, electron beams 29, a magnetism correcting magnet 30 for purity adjustment and the like, a getter 31, and a junction 32 at which the faceplate 21 and the funnel 22 are joined together.

As shown in FIG. 6, the faceplate 21, the funnel 22 and the neck 23 constitute a vacuum envelope, and the electron gun 24 is accommodated in the neck 23. The shadow mask 25, having a multiplicity of apertures and opposed to the phosphor screen 27 at a predetermined distance, is suspended from a skirt portion inside of the faceplate 21.

Although not shown, a so-called exterior conductor film is applied to the outside of the funnel 22, and the inside wall of the funnel 22 has a uniformly applied conductor film of graphite or the like which extends into part of the neck 23. The funnel 22 is also provided with an anode terminal which is disposed to extend through the conductor film and the exterior conductor film respectively applied to the inside and the outside of the funnel 22 as well as a portion of the funnel 22. The electron beams 29 are deflected horizontally and vertically by the deflection yoke 28 mounted on the outside wall of the portion of the vacuum envelope in which the funnel 22 meets the neck 23, thereby two-dimensionally scanning the phosphor screen 27.

The phosphor screen 27 is coated with three color phosphors for red, green and blue in stripes or dots, and the three electron beams 29 emitted from the electron gun 24 are selected by the shadow mask 25 and strike the respective color phosphors to make them emit light.

The electron gun 24 includes a plurality of coaxial electrodes, such as cathodes for generating electron currents, a control electrode, an accelerating electrode and a focusing electrode, and these electrodes are fixed and held at predetermined intervals by an insulating material (beading glass), such as bead glass.

FIG. 7*a* is an explanatory view of the assembly of electron gun electrodes according to a prior art, more specifically, an explanatory diagrammatic view of the assembly of a composite electrode which includes two electrode elements joined together in opposed relationship to each other.

FIG. 7*a* shows the assembly of the composite electrode which includes the two electrode elements joined together at their flanges. In FIG. 7*a*, reference numeral 41 denotes a composite electrode which includes electrode elements 4-1 and 4-2, reference numeral 4-1*a* denotes a flange of the electrode element 4-1, reference numeral 4-2*a* denotes a flange of the electrode element 4-2, reference numeral 10 denotes a spacer, reference numeral 11 denotes an alignment core of assembling tools, and reference numerals 12 and 13 denote the respective assembling tools. The respective electrode elements 4-1 and 4-2, which constitute the composite electrode 41 which is made up of two electrode elements to serve as one electrode, have the flanges 4-1*a* and 4-2*a* formed to be buried in the beading glass. The two electrode elements 4-1 and 4-2 are fitted onto the alignment core 11 of the assembling tools 12 and 13 in a stacked manner with the flanges 4-1*a* and 4-2*a* being opposed to each other, and the flanges 4-1*a* and 4-2*a* are united together, as by laser welding, within a predetermined space restricted by the spacer 10, thus preparing the composite electrode 41. The flanges 4-1*a* and 4-2*a* together with the other electrodes are fixedly buried in the beading glass.

FIG. 7*b* is an explanatory view of the assembly of a composite electrode which includes two electrode elements joined together at their cup-shaped bottom portions. In FIG. 7*b*, reference numeral 41' denotes a composite electrode which includes electrode elements 4'-1 and 4'-2, reference numeral 4'-1*a* denotes a flange of the electrode element 4'-1, reference numeral 4'-2*a* denotes a flange of the electrode element 4'-2, reference numeral 4'-1*b* denotes a cup-shaped bottom portion of the electrode element 4'-1, and reference numeral 4'-2*b* denotes a cup-shaped bottom portion of the electrode element 4'-2. Reference numerals 10, 11, 12 and 13 respectively denote a spacer, an alignment core of assembling tools, and the assembling tools, all of which are identical to those shown in FIG. 7*a*. Similarly to the prior art shown in FIG. 7*a*, the respective electrode elements 4'-1 and 4'-2, which constitute the composite electrode 4', which is made up of two electrode elements to serve as one electrode, have the flanges 4'-1*a* and 4'-2*a* formed to be buried in the beading glass. The two electrode elements 4'-1 and 4'-2 are fitted onto the alignment core 11 of the assembling tools 12 and 13 in a stacked manner with the cup-shaped portions 4'-1*b* and 4'-2*b* being opposed to each other, and the cup-shaped portions 4'-1*b* and 4'-2*b* are united together, as by laser welding, within a predetermined space restricted by the spacer 10, thus preparing the composite electrode 41'. The flanges 4'-1*a* and 4'-2*a* together with the other electrodes are fixedly buried in the beading glass.

FIG. 8*a* is an explanatory view of one of the above-described electrode elements, FIG. 8*b* is a cross-sectional view taken along line C-O-C, of FIG. 8*a*, FIGS. 8*c* and 8*d* are explanatory enlarged views showing deformation of the portion D shown in FIG. 8*b*, and FIGS. 8*e* and 8*f* are explanatory enlarged views showing deformation of the portion E shown in FIG. 8*b*.

In FIGS. 8*a* to 8*f*, the reference numerals marked with a prime indicate the constituent portions of the composite electrode shown in FIG. 7*b* which includes the two electrode elements joined together at their cup-shaped bottom portions, while the other reference numerals indicate the constituent portions of the composite electrode shown in FIG. 7*a* which includes the two electrode elements joined together at their flanges.

In the process of forming the composite electrode by joining the electrode elements together at their flanges as shown in FIG. 7*a*, the flange 4-2*a* is press-formed integrally with the electrode element 4-2 in parallel with a plane normal to the axial direction of the electrode element 4-2. In practice, however, as shown in FIGS. 8*c* and 8*d*, the flange 4-2*a* tends to be curved as indicated by $\theta_1$ or $\theta_2$ toward or away from the other electrode element owing to bending stress. If such two electrode elements are united together, it will be difficult to accurately obtain the electrode height H shown in FIG. 7*a*.

In the process of forming the composite electrode by joining the electrode elements together at their cup-shaped bottom portions as shown in FIG. 7*b*, the bottom portion 4'-1*b* of the electrode element 4'-1 to be united to the bottom portion of the other electrode element tends to be curved as indicated by $\theta_3$ or $\theta_4$ away from or toward the other electrode element, as shown in FIGS. 8*e* and 8*f*, owing to bending stress similar to the above-described one. If such two electrode elements are united together, it will be difficult to accurately obtain the electrode height H' shown in FIG. 7*b*.

As described above, electron gun assemblies for use in color cathode-ray tubes or the like are assembled by stacking a plurality of electrodes including the above-described composite electrode by means of assembling tools and insulatively holding the stacked electrodes at predetermined intervals with beading glass.

The assembly precision of such electron gun is determined by the concentricity of the electron-beam passage holes of the respective electrodes and the degree of squareness between the end face of each of the electrodes and the axis of the electron gun, and this precision greatly influences the focusing characteristics of the cathode-ray tubes.

A prior art which relates to this kind of electron gun is disclosed in, for example, Japanese Patent Laid-Open No. 136134/1985.

As is apparent from the above description, the aforesaid prior art involves the problem that deformation due to bending stress occurs in the flange portion or the cup-shaped bottom portion of either of the electrode elements of the composite electrode which constitutes part of the electron gun, and this leads to a lowering in the assembly precision of a finished electron gun.

SUMMARY OF THE INVENTION

A first object of the present invention is, therefore, to solve the problems of the above-described prior art and provide a precision electron gun improved by bending the electrode elements in directions normal to the direction in which the electrodes are arrayed, and the projections are butted against each other and united together.

To achieve the second object, in accordance with another aspect of the present invention, there is provided a method of assembling an electron gun which comprises the steps of forming faces of the respective electrode elements which constitute a composite electrode to extend in directions normal to the direction in which electrodes are arrayed, providing projections on the faces of the respective electrode elements, concentrically inserting the electrode elements between the assembling tools, and uniting together the projections provided on the respective electrode elements with the projections being butted against one another.

According to the present invention, it is possible to reduce the deformation of a composite electrode due to deformation which occurs in the united portions of electrode elements after they have been united together.

By applying the present invention to a cup-shaped electrode element and a planar electrode element, it is possible to reduce the deformation of the electrode element or an electrode, whereby it is possible to provide an electron gun of uniform quality having accurate concentricity of electron-beam passage holes, smaller the reduction of deformation of an electrode during assembly as well as good focusing performance due to the elimination of positional deviation of electron beams.

A second object of the present invention is to provide a method of assembling a precision electron gun improved by the reduction of deformation of an electrode during assembly as well as good focusing performance due to the elimination of positional deviation of electron beams.

To achieve the first object, in accordance one aspect of the present invention, there is provided an electron gun which comprises a composite electrode including at least two electrode elements united together. The electrode elements have faces formed to extend in directions normal to the direction in which electrodes are arrayed, and the faces are provided with projections which serve to constitute the composite electrode when the projections are united together in opposed relationship to each other.

In another form of the electron gun, such projections may be formed on flange portions formed by bending the electrode elements in directions normal to the direction in which the electrodes are arrayed, and the projections are butted against each other and united together.

In still another form of the electron gun, such projections may be formed on bottom portions formed by deviation error of electron beams and reduced variations in focusing characteristics.

BRIEF DESCRIPTION OF THE DRAWINGS

FIG. 8*a* is an explanatory view of the structure of one of conventional electrode elements;

FIG. 8*b* is a cross-sectional view taken along line C-O-C' of FIG. 8*a;*

FIG. 8*c* is an enlarged view of the portion D shown in FIG. 8*b;*

FIG. 8*d* is an enlarged view of the portion D shown in FIG. 8*b;*

FIG. 8*e* is an enlarged view of the portion E shown in FIG. 8*b*; and

FIG. 8*f* is an enlarged view of the portion E shown in FIG. 8*b*.

DESCRIPTION OF THE PREFERRED EMBODIMENTS

First Embodiment

The embodiments of the present invention will be described below in detail with reference to the accompanying drawings.

Figure 1A:
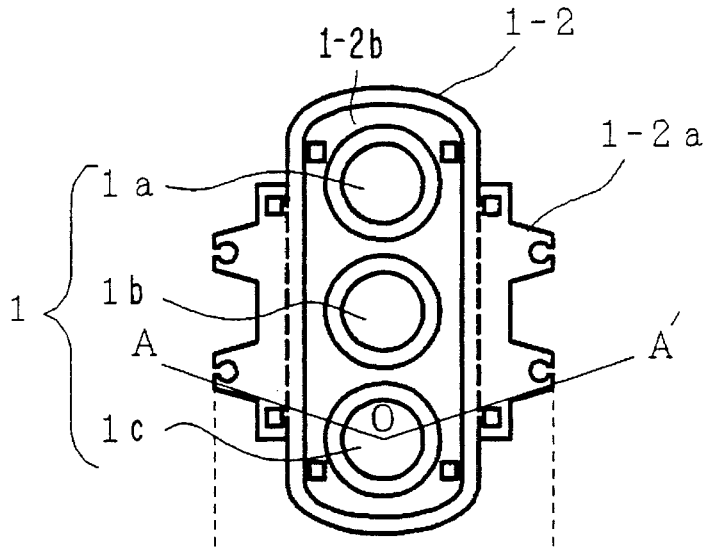
FIG. 1*a* is an explanatory view of the essential electrode arrangement of one embodiment of an electron gun according to the present invention, showing one electrode element which constitutes part of a composite electrode.
Figure 1B:
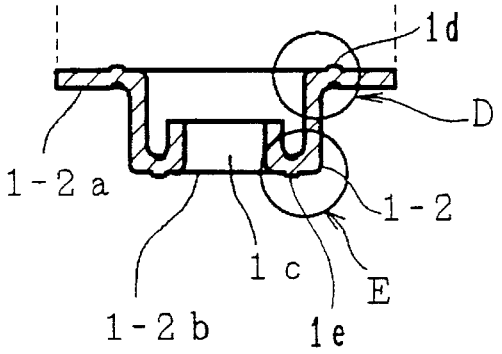
FIG. 1*b* is a cross-sectional view taken along line A-O-A' of FIG. 1*a;*
Figure 1C:
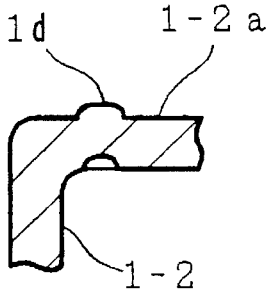
FIG. 1*c* is an enlarged view of the portion D shown in FIG. 1*b;*
Figure 1D:
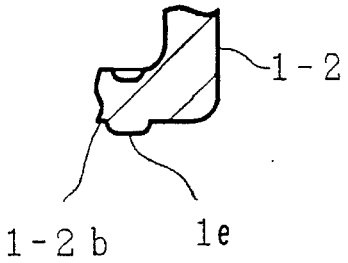
FIG. 1*d* is an enlarged view of the portion E shown in FIG. 1*b;*

FIG. 1*a* is an explanatory view of the essential electrode arrangement of one embodiment of an electron gun according to the present invention and shows one electrode element which constitutes part of a composite electrode. FIG. 1*b* is a cross-sectional view taken along line A-O-A' of FIG. 1*a*, FIG. 1*c* is an enlarged view of the portion D shown in FIG. 1*b*, and FIG. 1*d* is an enlarged view of the portion E shown in FIG. 1*b*.

In this embodiment, the present invention is applied to a composite electrode which constitutes part of an electron gun for a color cathode-ray tube of an in-lane three-electron-beam type, and the shown electrode element and an electrode element of the same shape are combined to constitute one composite electrode.

In FIG. 1*a*, reference numeral 1-2 denotes one electrode element which constitutes part of a composite electrode. Three electron-beam passage holes 1 (1*a*, 1*b* and 1*c*) are formed in line in the electrode element 1-2, and flanges 1-2*a* are formed on opposite sides of the electrode element 1-2 to extend in opposite directions normal to the direction in which the electron-beam passage holes 1 are arrayed. Electrode bottom portions 1-2*b* are formed in parallel with the flanges 1-2*a*.

Each of the flanges 1-2*a* is formed to have extending portions each having at its extending end a cutout portion to be fixedly buried in beading glass. As shown in FIG. 1*c*, projections 1*d* are formed on the flanges 1-2*a* in such a manner as to project toward the other electrode element.

As shown in FIG. 1*d*, each of the cup-shaped electrode bottom portions 1-2*b* has projections 1*e* formed at its corner portion in such a manner as to project away from the other electrode element.

It is to be noted that, in any composite electrode of the type in which two electrode elements are united together, portions in which to form the aforesaid projections are not limited to flange portions or electrode bottom portions. The projections may also be formed in any portion of opposite faces which are formed to extend in the direction normal to that in which electrodes are arrayed. In addition, although, in the electrode element shown in FIG. 1*a*, four projections are formed on each of the flange portion and the electrode bottom portion, at least three projections may be formed in the same plane on each of the opposite faces. Further, although in this embodiment the electrode elements of the saw shape are combined to constitute one composite electrode, various other electrode elements having different shapes, such as a cup-like shape or a planar shape, are available as such electrode elements in individual forms of combination.

Figure 2:
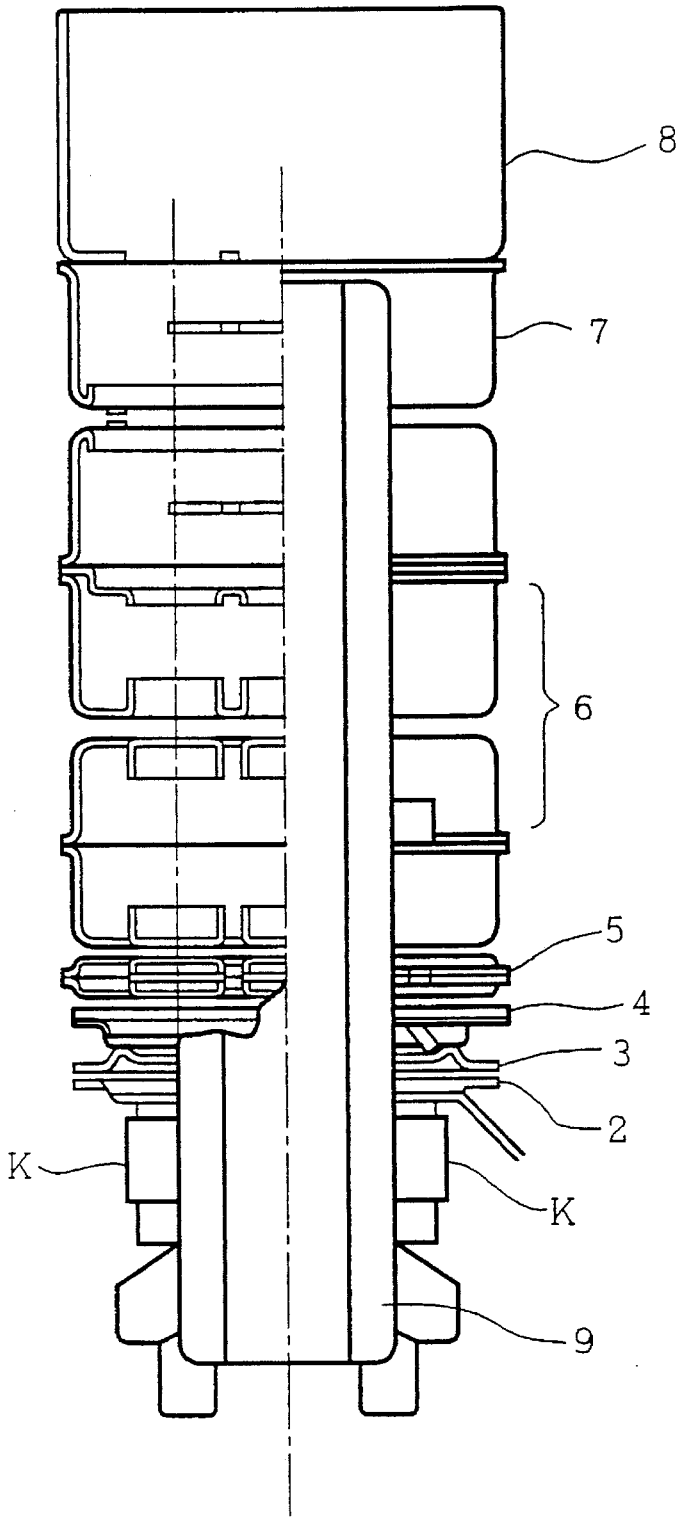
FIG. 2 is a partly broken away, explanatory side view of the entire arrangement of one example of an electron gun to which the present invention is applied.

FIG. 2 is a partly broken away, explanatory side view of the entire arrangement of one example of an electron gun to which the present invention is applied. The shown electron gun includes cathodes K, a first electrode 2, a second electrode 3, a third electrode 4, a fourth electrode 5, a fifth electrode 6, a sixth electrode 7, a shield cup 8 and beading glass 9.

In the shown electron gun, the first electrode 2 and the second electrode 3 are simple electrodes, while the third electrode 4 to the sixth electrode 7 are composite electrodes each including two electrode elements united together in opposed relationship to each other. Incidentally, the shield cup 8 is fixed to the sixth electrode 7.

The first electrode 2, the second electrode 3, the third electrode 4, the fourth electrode 5, the fifth electrode 6 and the sixth electrode 7 are spaced apart from one another at predetermined intervals, and their respective flange portions are fixedly buried in the beading glass 9.

Three electron beams emitted from the respective cathodes K undergo the required focusing and acceleration while passing through the first electrode 2 to the sixth electrode 7, reach a phosphor screen which is not shown, and reproduce on the phosphor screen in image based on an image signal applied to the first electrode 2.

According to the first embodiment of the present invention, the deformation of an electrode due to stress during assembly can be reduced to improve the assembly precision, thereby eliminating the positional deviation of electron beams from an electron gun. Accordingly, it is possible to obtain an electron gun having good focusing performance.

Second Embodiment

Figure 3:
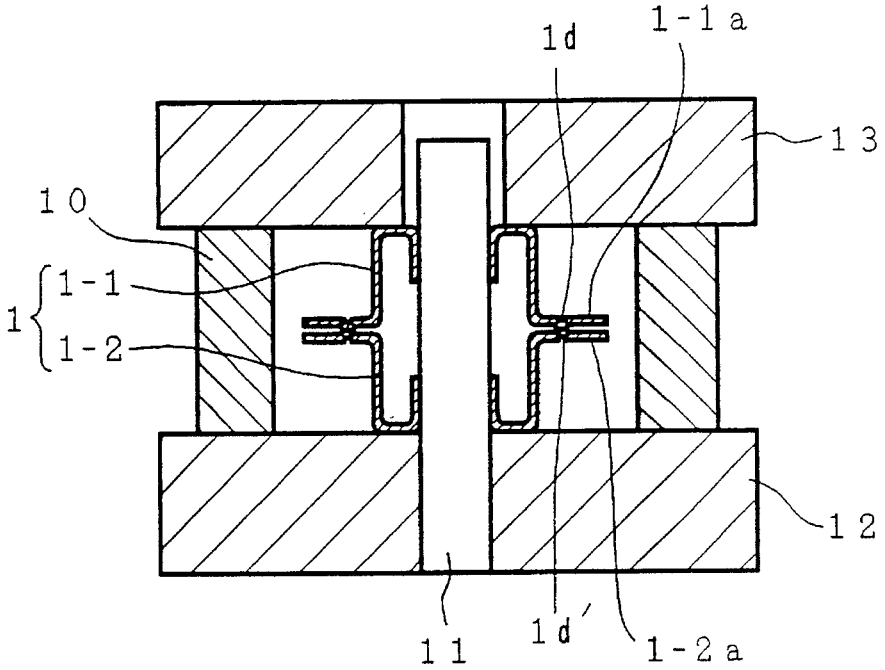
FIG. 3 is an explanatory view of one embodiment of a method of assembling an electrode for an electron gun according to the present invention.

FIG. 3 is, an explanatory view of one embodiment of a method of assembling an electrode for an electrode gun according to the present invention. In FIG. 3, identical reference numerals are used to denote portions identical to those shown in FIG. 1*b*. As shown in FIG. 3, each electrode element which constitutes part of a composite electrode has flanges which are bent from the electrode element in opposite directions along a plane normal to the direction in which electrodes are arrayed (the axial direction of the electron gun), thereby extending into their corresponding beading glass sides.

FIG. 3 is an explanatory view of a method of assembling the composite electrode for an electron gun according to the present invention, which composite electrode includes the electrode elements united together at the flanges. In FIG. 3, reference numeral 1 denotes a composite electrode made up of electrode elements 1-1 and 1-2, reference numeral 1-1*a* denotes a flange of the electrode element 1-1, reference numeral 1-2*a* denotes a flange of the electrode element 1-2, reference numeral 10 denotes a spacers reference numeral 11 denotes an alignment core of assembling tools, and reference numerals 12 and 13 denote the assembling tools. The respective electrode elements 1-1 and 1-2, which constitute the composite electrode 1 which is made up of two electrode elements to serve as one electrode, have the flanges 1-1*a* and 1-2*a* formed to be buried in the beading glass. The two electrode elements 1-1 and 1-2 are fitted onto the alignment core 11 of the assembling tools 12 and 13 in a stacked manner with projections 1*d* formed on the flanges 1-1*a* and projections 1*d*' formed on the flanges 1-2*a* being opposed to each other. The projections 1*d* and 1*d*' formed on the respective flanges 1-1*a* and 1-2*a* are united together, as by laser welding, within a predetermined space restricted by the spacer 10, thus preparing the composite electrode 1. The flanges 1-1*a* and 1-2*b* together with the other electrodes are fixedly buried in the beading glass.

These flanges have the projections formed at locations which allow the projections of the flanges to adjoin the corresponding projections of the flanges when the two electrode elements are butted against each other. The projections are formed on a flat portion between the bent portion and the extending end of each of the flanges of the respective electrode elements.

In addition, the projections formed between the bent portion and the extending end of each of the flanges of the electrode elements, while they are formed so that the projections of the respective two electrode elements can positionally correspond to one another when the electrode elements are opposed to each other in the axial direction. Accordingly, in the process of fitting the electrode elements onto the alignment core of the assembling tools and laser-welding the electrode elements together with their flanges being butted against one another, curvatures which may occur in the flanges during such process are absorbed by the respective projections, so that no substantial curvatures remain.

Accordingly, the deformation of an electrode due to the aforesaid stress during assembly can be reduced to improve the assembly precision, thereby eliminating the positional deviation of electron beams from an electron gun. Accordingly, it is possible to obtain an electron gun having good focusing performance.

Third Embodiment

Figure 4:
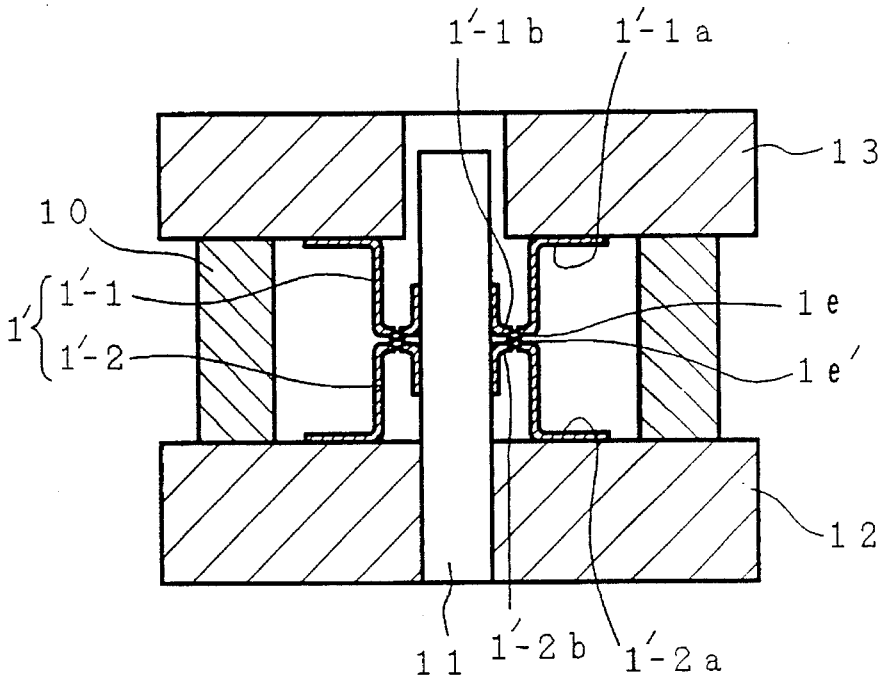
FIG. 4 is an enlarged view of another embodiment of the method of assembling an electrode for an electrode gun according to the present invention, showing a portion in which electrode elements are butted against each other.

FIG. 4 is in explanatory view of another embodiment of the method of assembling an electrode for an electron gun according to the present invention. In FIG. 4, identical reference numerals are used to denote portions identical to those shown in FIG. 1*b*. As shown in FIG. 4, each electrode element which constitutes part of a composite electrode has electrode bottom portions formed on opposite sides in a plane normal to the direction in which electrodes are arrayed (the axial direction).

FIG. 4 is an explanatory view of a method of assembling the composite electrode for an electron gun according to the present invention. The composite electrode includes the electrode elements united together at their cup-shaped bottom portions. In FIG. 4, reference numeral 1' denotes a composite electrode made up of electrode elements 1'-1 and 1'-2, reference numeral 1'-1*a* denotes a flange of the electrode element 1'-1, reference humeral 1'-2*a* denotes a flange of the electrode element 1'-2, reference numeral 1'-1*b* denotes a cup-shaped bottom portion of the electrode element 1'-1, and reference numeral 1'-2*b* denotes a cup-shaped bottom portion of the electrode element 1'-2. Reference numerals 10, 11, 12 and 13 denote Reference numerals 10, 11, 12 and 13 respectively denote a spacer, an alignment core of assembling tools, and the assembling tools, all of which are identical to those shown in FIG. 3.

Similarly to the prior art shown in FIG. 3, the respective electrode elements 1'-1 and 1'-2, which constitute the composite electrode 1' which is made up of two electrode elements serving as one electrode, have the flanges 1'-1*a* and 1'-2*a* formed to be buried in the beading glass.

The two electrode elements 1'-1 and 1'-2 are fitted onto the alignment core 11 of the assembling tools 12 and 13 in a stacked manner with projections 1*e* and 1*e*' formed on the respective cup-shaped portions 1'-1*b* and 1'-2*b* being opposed to each other. The projections 1*b* and 1*b*, formed on the respective cup-shaped portions 1'-1*b* and 1'-2*b* are united together, as by laser welding, within a predetermined space restricted by the spacer 10, thus preparing the composite electrode 1'. The flanges 1'-1*a* and 1'-2*a* together with the other electrodes are fixedly buried in the beading glass.

The projections are formed on the respective bottom portions of the electrode elements at locations which allow the projections to adjoin one another when the two electrode elements are butted against each other.

In addition, the projections on the respective bottom portions are formed so that the projections of the respective two electrode elements can positionally correspond to one another when the electrode elements are opposed to each other in the axial direction. Accordingly, in the process of fitting the electrode elements onto the alignment core of the assembling tools and laser-welding the electrode elements together with their electrode bottom portions being butted against one another, curvatures which may occur in the electrode bottom portions during such process are absorbed by the respective projections, so that no substantial curvatures remain.

Accordingly, the deformation of an electrode due to the aforesaid stress during assembly can be reduced to improve the assembly precision, thereby eliminating the positional deviation of electron beams from an electron gun. Accordingly, it is possible to obtain an electron gun having good focusing performance.

Fourth Embodiment

Figure 5:
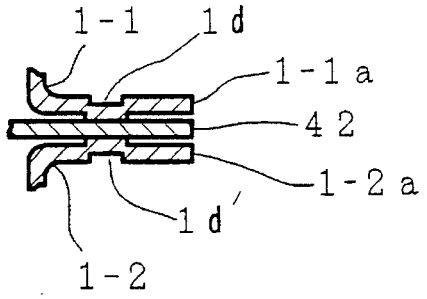
FIG. 5 is an explanatory view of yet another embodiment of the method of assembling an electrode for an electrode gun according to the present invention.
Figure 6:
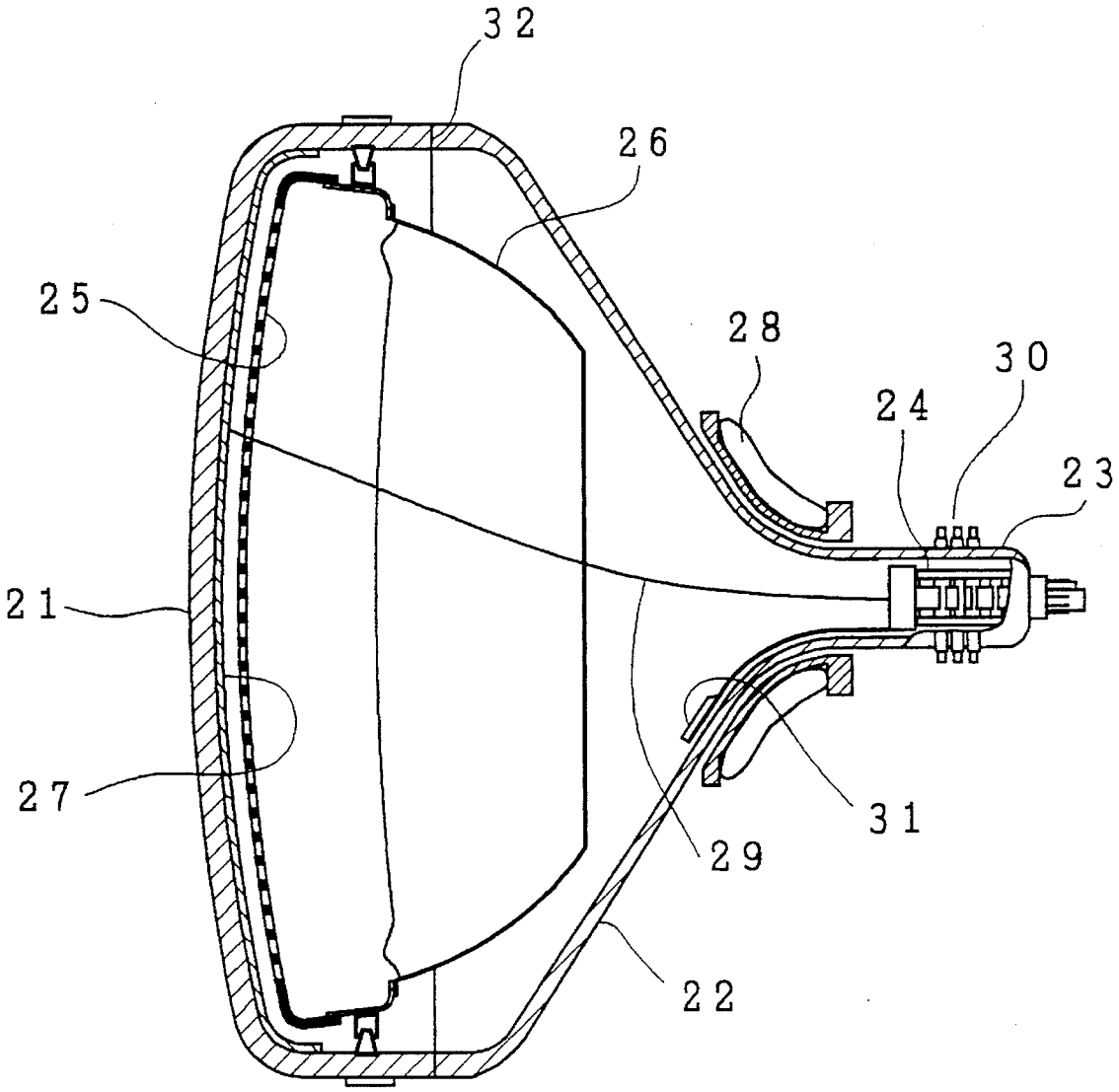
FIG. 6 is an explanatory cross-sectional view of the structure of a cathode-ray tube.

FIG. 5 is an explanatory view of yet another embodiment of the method of assembling an electrode for an electrode gun according to the present invention.

As shown in FIG. 5 on an enlarged scale, the projection 1*d* is formed on the flange 1-1*a* of a first electrode element, while the portion 1*d*' is formed on the flange 1-2*a* of a second electrode element, and the two electrode elements are united together with the projections 1*d* and 1*d*' being opposed to each other across an intermediate electrode element 42.

The first electrode element, the intermediate electrode element and the second electrode element are stacked and united together to form a composite electrode. The electron gun includes a plurality of electrodes which are sequentially arrayed along a single axis in predetermined spaced relationship, and the butt faces of the first electrode element, the intermediate electrode element and the second electrode element are respectively formed to be normal to the aforesaid axis.

In the embodiment shown in FIG. 5, the intermediate electrode element 42 disposed between the first electrode element 1-1 and the second electrode element 1-2 has a planar shape, and no projection is provided on the intermediate electrode element 42. Since the flat surfaces of such planar electrode element can be press-formed, even if no production is provided, it is possible to easily align the axes of the electrode elements without causing electrode deformation. According to the fourth embodiment of the present invention, the deformation of an electrode due to stress during assembler can be reduced to improve the assembly precision, thereby eliminating the positional deviation of electron beams from an electron gun. Accordingly, it is possible to obtain an electron gun having good focusing performance.

The intermediate electrode element disposed between the two electrode elements may be cup-shaped or planer if the projections 1*a* are formed on the respective butt portions of the faces of the two electrode elements which are to be opposed to each other. Further, if projections are provided on the intermediate electrode element disposed between the two electrode elements, it is possible to obtain equivalent effects.

Fifth Embodiment

In FIG. 1*a*, reference numeral 1-2 denotes one electrode element which constitutes part of a composite electrode. Three electron-beam passage holes 1 (1*a*, 1*b* and 1*c*) are formed in line in the electrode element 1-2, and the flanges 1-2*a* are formed on opposite sides of the electrode element 1-2 to extend in opposite directions normal to the direction in which the electron-beam passage holes 1 are arrayed. The electrode bottom portions 1-2*b* are formed in parallel with the flanges 1-2*a*.

Each of the flanges 1-2*a* is formed to have extending portions each having at its extending end a cutout portion to be fixedly buried in the beading glass. As shown in FIG. 1*b*, the projections 1*b* are formed on the flanges 1-2*a* in such a manner as to project toward the other electrode element.

Each of the cup-shaped electrode bottom portions 1-2*b* has the projections 1*e* formed at its corner portion in such a manner as to project away from the other electrode element.

It is to be noted that the projections may be formed on only the flanges in the case of the composite electrode having the arrangement shown in FIG. 3 or on only the electrode bottom portions in the case of the composite electrode having the arrangement shown in FIG. 5.

Figure 7A:
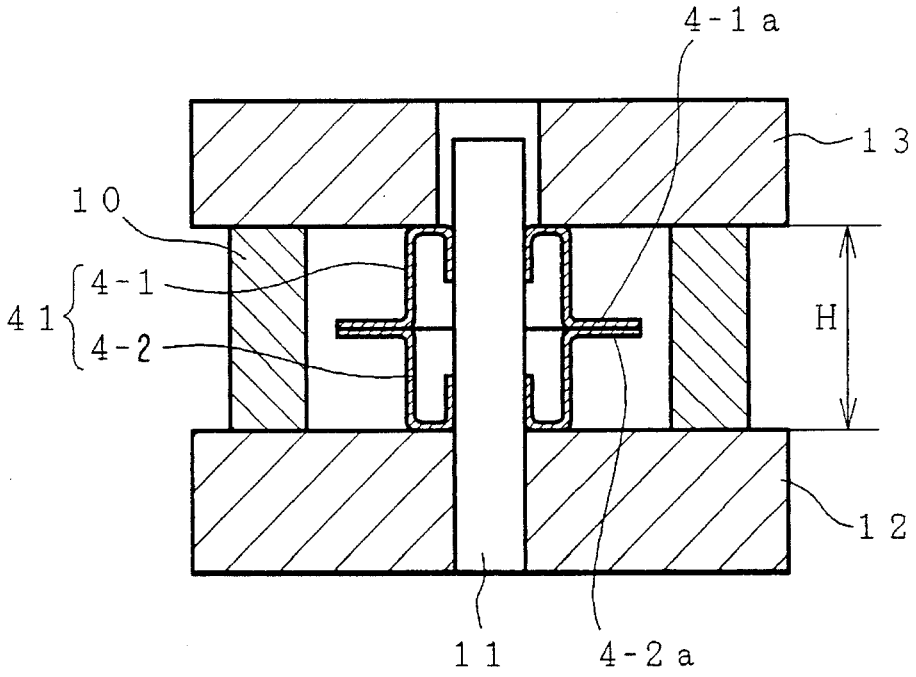
FIG. 7*a* is an explanatory view of one example of a method of assembling an electrode for an electron gun according to a prior art.
Figure 7B:
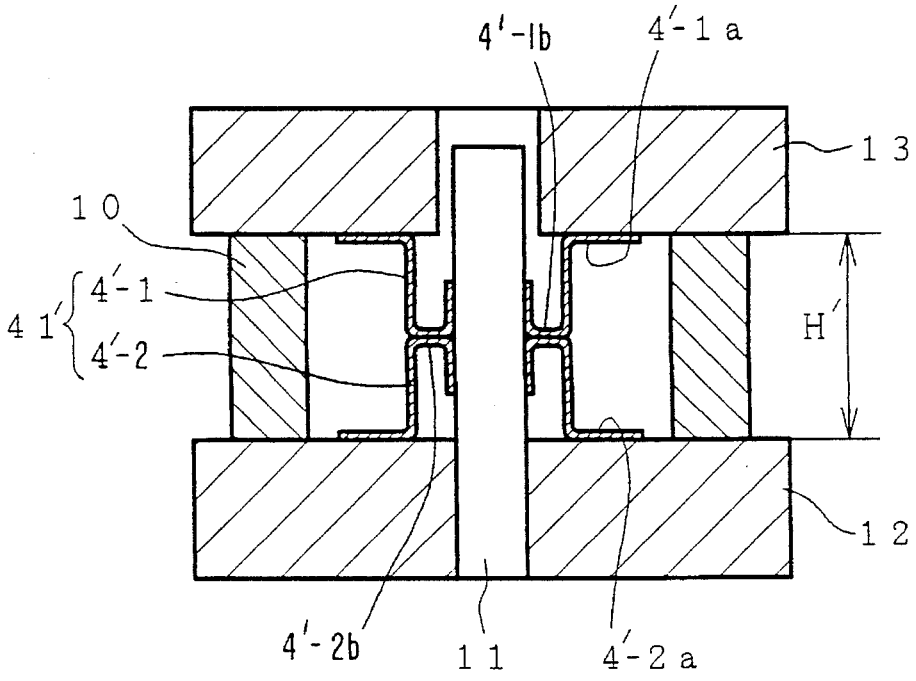
FIG. 7*b* is an explanatory view of another example of the method of assembling an electrode for an electron gun according to the prior art.

The electrode element 1-2 arranged in the above-described manner and the other electrode element are fitted onto an alignment core of assembling tools similar to those shown in FIG. 7*a*, and are laser-welded with the flanges or the electrode bottom portions of both electrode elements being butted against each other.

Since the projections formed on the flanges 1-2*a* or the electrode bottom portions 1-2*b* are butted against the opposed projections, neither pressure due to the tools nor stress due to laser welding causes deformation of the electrode elements and the influences of curvatures which may occur in the flanges or the electrode bottom portions are cancelled. Accordingly, it is possible to perform high-precision assembly.

In addition, since an electron gun can be assembled without affecting the relative positional relationships between individual electrodes or deviating the axes of the electron-beam passages holes, the assembly precision can be improved to eliminate the positional deviation of electron beams from an electron gun. Accordingly, it is possible to obtain an electron gun having good focusing performance.

In addition, it is possible to reduce deformation of electrodes elements or electrodes during the assembly of an electron gun, whereby it is possible to provide an electron gun of uniform quality having accurate concentricity of electron-beam passage holes, smaller deviation error of electron beams and reduced variations in focusing characteristics.

Although in any of the above-described embodiments the present invention is applied to an electron gun for an in-line type of color cathode-ray tube, the present invention is not limited to such an electron gun and can also be applied to any other type of electron gun having a composite electrode. As a matter of course, the present invention can also be applied to a simple electrode having a flange or an electrode component of diaphragm shape having no flange. Further, the present invention can be applied to not only the uniting of two electrode elements but also that of three electrode elements.

What is claimed is:

1. An electron gun comprising: a composite electrode including at least two electrode elements united together; and a plurality of electrodes sequentially arrayed along a single axis at predetermined intervals, wherein opposed faces of said electrode elements which constitute said composite electrode are perpendicular to said axis and said opposed faces are provided with projections which constitute said composite electrode when said projections are united together in opposed relationship to each other.

2. An electron gun according to claim 1, wherein said opposed faces are defined by flange portions formed by bending said electrode elements perpendicularly to said axis, said projections being provided on said flange portions.

3. An electron gun according to claim 1, wherein said opposed faces are defined by bottom portions formed by bending said electrode elements perpendicularly to said axis, said projections being provided on said bottom portions.

4. An electron gun comprising: a composite electrode including a first electrode element, an intermediate electrode element and a second electrode element all of which are united together in a stacked manner, and a plurality of electrodes sequentially arrayed along a single axis at predetermined intervals, wherein opposed faces of said electrode elements which constitute said composite element are perpendicular to said axis and projections are provided on the face of said first electrode element which adjoins said intermediate electrode element, while projections are provided on the face of said second electrode element which adjoins said intermediate electrode element, said intermediate electrode element positioned between said first electrode element and said second electrode element being a planar electrode element.

5. A method of assembling an electron gun by sequentially arraying at least two electrode elements along a single axis between assembling tools and uniting said electrode elements together to prepare a composite electrode, comprising the steps of: forming opposed faces of said electrode elements of said composite electrode, said opposed faces being perpendicular to said axis; providing projections on said opposed faces of said electrode elements; concentrically inserting said electrode elements between said assembling tools; and uniting together said projections provided on said respective electrode elements with said projections being butted against one another.

* * * * *